US006745678B1

(12) United States Patent
Liu et al.

(10) Patent No.: US 6,745,678 B1
(45) Date of Patent: Jun. 8, 2004

(54) DEADLOCK STRAP RELEASING DEVICE FOR A STRAPPING MACHINE

(75) Inventors: Chin-Chang Liu, Taichung (TW); Chi-jan Su, Taipei (TW)

(73) Assignee: Tekpak Corporation, Taipei (TW)

( * ) Notice: Subject to any disclaimer, the term of this patent is extended or adjusted under 35 U.S.C. 154(b) by 0 days.

(21) Appl. No.: 10/329,433

(22) Filed: Dec. 27, 2002

(51) Int. Cl.[7] ..... B65B 13/04; B65B 57/10
(52) U.S. Cl. ..... 100/26; 100/4; 53/589
(58) Field of Search ..... 100/2, 4, 26, 29, 100/30, 31, 32; 53/399, 589

(56) References Cited

U.S. PATENT DOCUMENTS 3,536,430 A * 10/1970 Yasumori ..... 100/4
5,287,802 A * 2/1994 Pearson ..... 100/4
5,746,882 A * 5/1998 Bell et al. ..... 156/580
6,082,254 A * 7/2000 De Vlaam ..... 100/2

* cited by examiner

*Primary Examiner*—Allen Ostrager
*Assistant Examiner*—Jimmy Nguyen
(74) *Attorney, Agent, or Firm*—Troxell Law Office PLLC

(57) ABSTRACT

A deadlocked strap releasing device for a strapping machine includes a pull rod for pulling a pull rope for ejecting a deadlocked strap by a push member of a strap ejector above a worktable for a worker to pull out and cut off the redundant portion of the strap and correct malfunction so as to start the machine for continuing strapping quickly.

7 Claims, 7 Drawing Sheets

DEADLOCK STRAP RELEASING DEVICE FOR A STRAPPING MACHINE

BACKGROUND OF THE INVENTION

This invention relates to a deadlocked strap releasing device for a strapping machine, particularly to one swiftly releasing a deadlocked strap when the strap is deadlocked in the machine.

A conventional strapping machine 10 shown in FIGS. 1 and 2 has an automatic strap guiding device guiding a strap 11 from a strap moving device 12 into a guider 13 and then into a guide rail 15 positioned around an upper arcuate frame 14. Meanwhile an open guide groove 151 is provided in one side of the guide rail 15 to guide one end of the strap 11 to move into a weld and cut device 16, with the extended long strap formed to have an upper portion and a lower portion overlapped. Then the guide rail 15 is operated to move to one side to let the strap 11 separate from the guide groove 151 so that the band moving device may retreat the strap 11 for tightening the strap 11 to move toward the arcuate frame 14 to pack on the object W to be packed placed on a work table 17. And then the strap 11 is welded and cut off to finish packing.

By the way, the strap 11 may sometimes be deadlocked in the guide groove 151 during moving action of the strap 11, impossible to carry on packing. Then the packing machine has to be stopped in operation to move the guide rail 15 to let the strap 11 separate from the guide groove 151. Next, a worker has to pull the strap 11 out of an open in 171 formed in the worktable 17, and the packing machine is started again and redundant portion of the strap 11 is to be cut off, releasing the deadlocked strap.

Though the worker can pull the strap 11 out of the opening 171 of the worktable 17, the opening 171 is so small as to hardly let a finger to pass through, so practically it is not so easy to extend a finger into the opening 171 to pull up the deadlocked strap 11. The worker may use a hook to hook out the strap 11 to release the deadlocked strap, but the chance may be that a proper hook is not available at hand or it is to be prepared in advance for use, otherwise the deadlocked strap is not easily released in the conventional packing machine.

SUMMARY OF THE INVENTION

This invention has been devised to offer a deadlocked strap releasing device for a strapping machine, which is positioned in the machine body, uses a pull rod to directly push a strap pusher together with the strap to protrude up a worktable so as to permit a worker to pull out the strap to release it in the deadlocked position and to carry on packing smoothly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
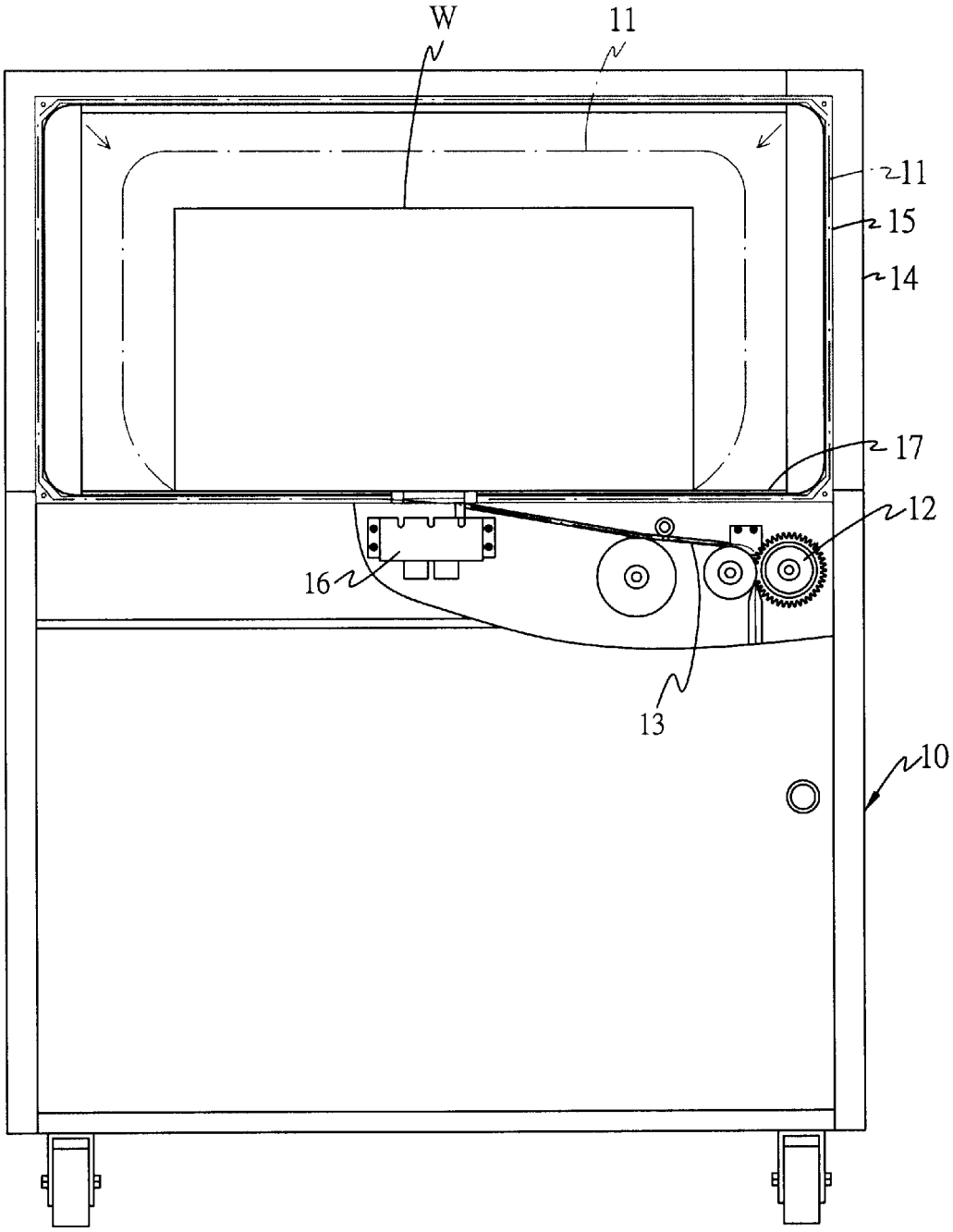
FIG. 1 PRIOR ART
FIG. 1 is an operational view of a conventional strapping machine.
Figure 2:
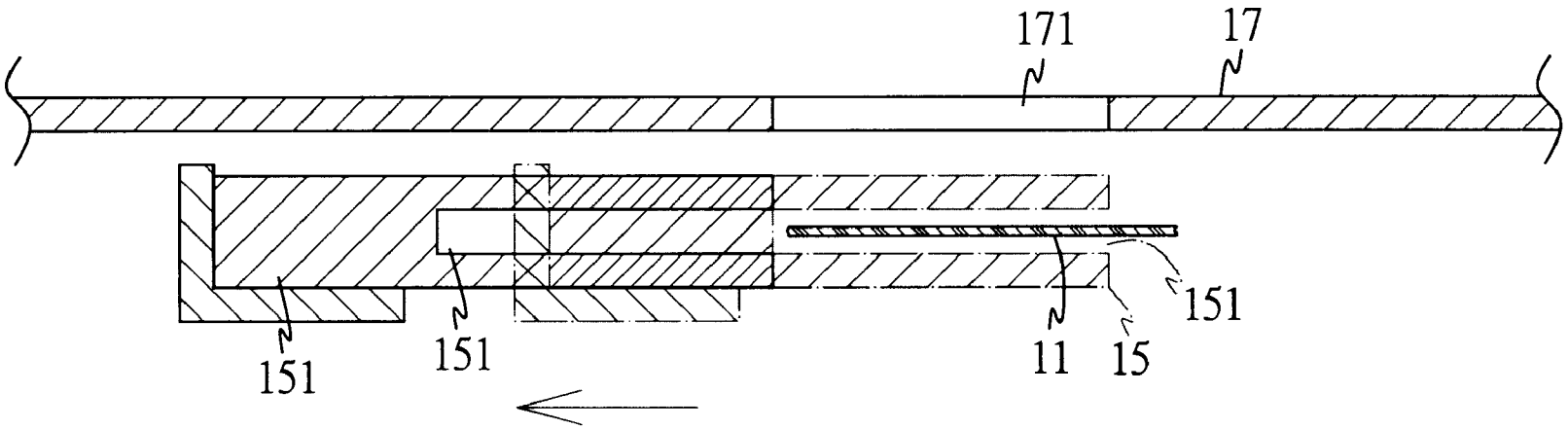
FIG. 2 PRIOR ART
FIG. 2 is a partial cross-sectional view of a guide rail carrying a strap in the conventional strapping machine.
Figure 3:
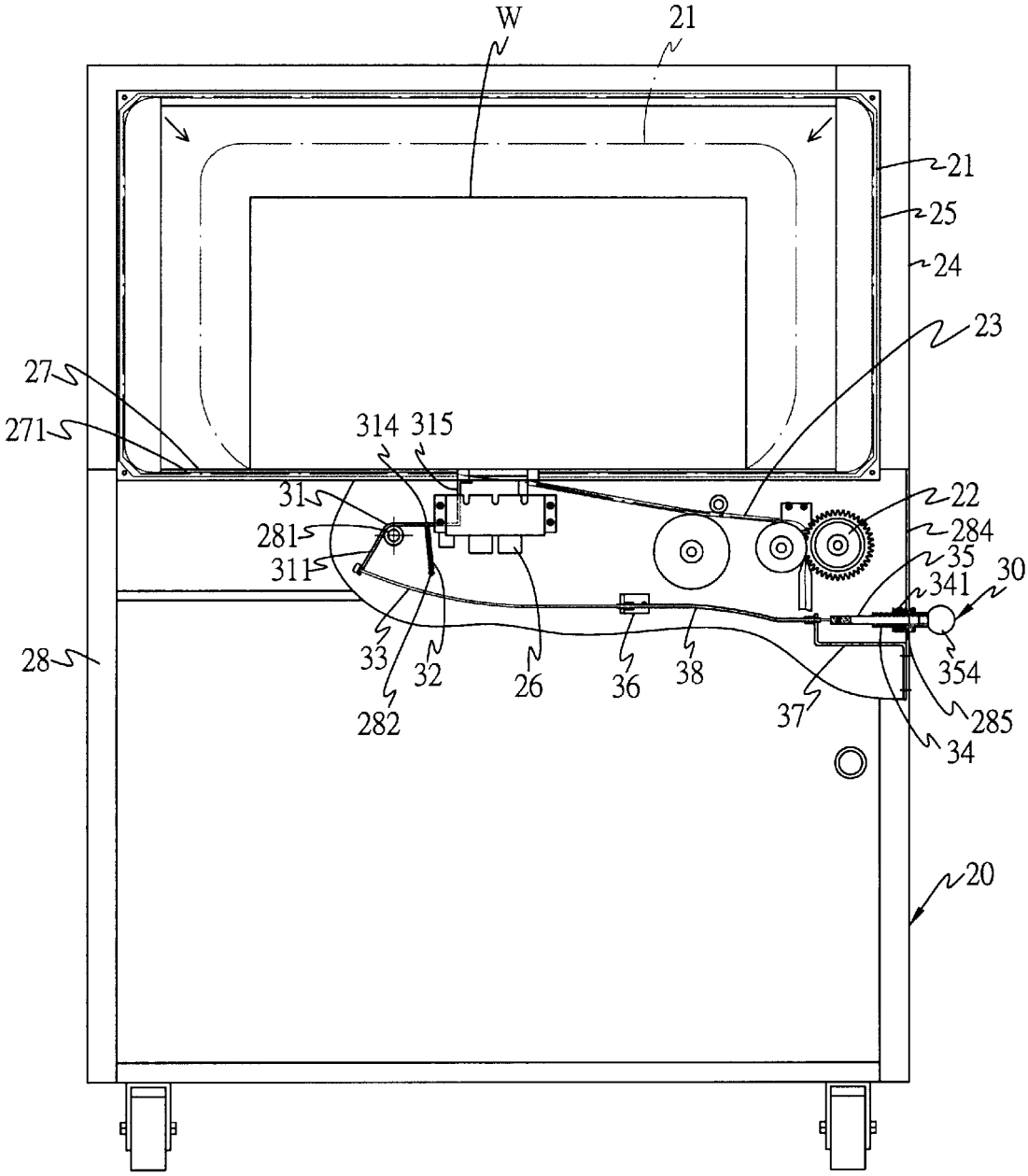
FIG. 3 is side operational view of a strapping machine with a deadlocked strap releasing device in the present invention.
Figure 4:
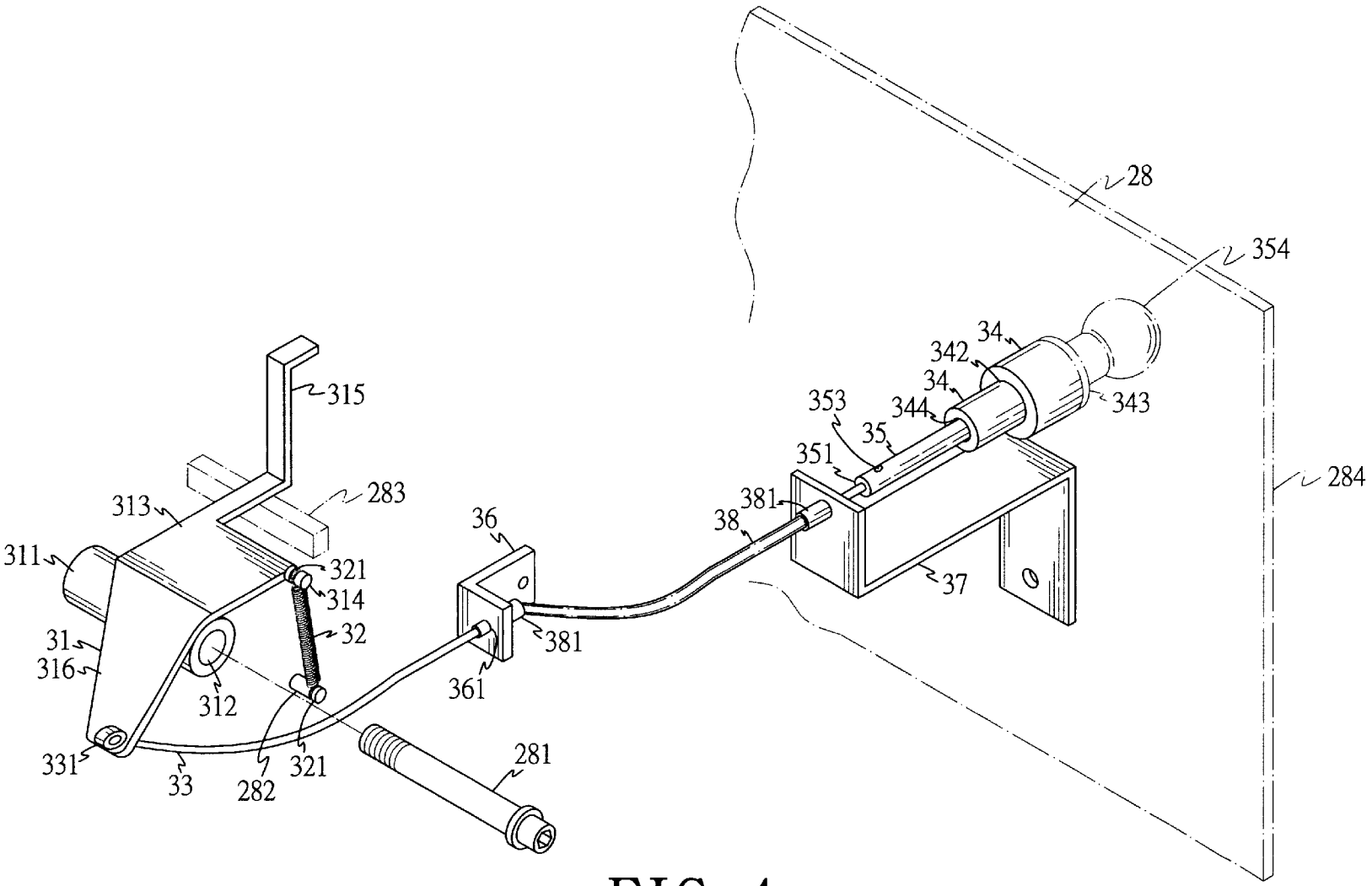
FIG. 4 is a perspective view of the deadlocked strap releasing device for a strapping machine in the present invention.
Figure 5:
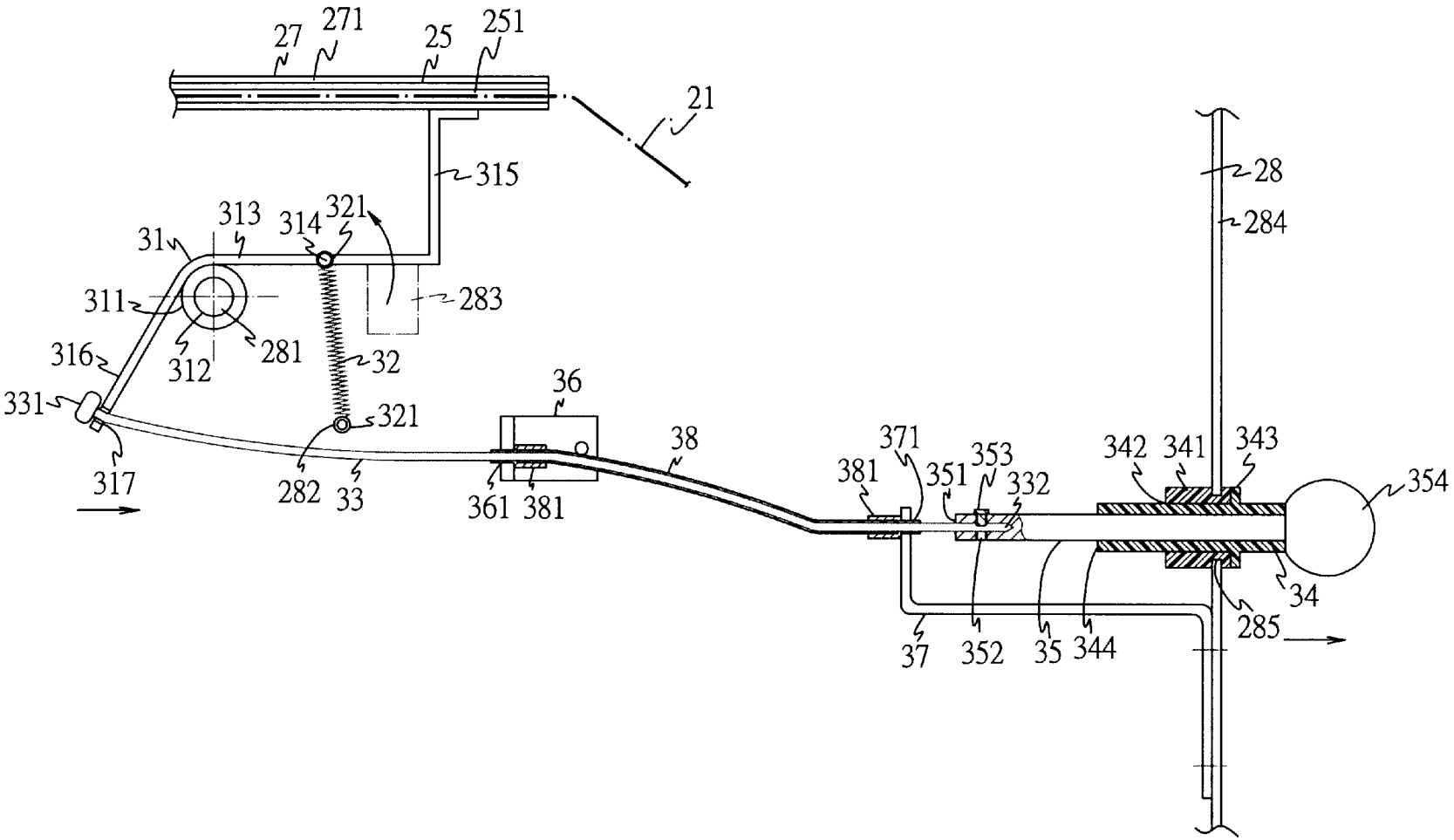
FIG. 5 is a cross-sectional view of the deadlocked strap releasing device for a strapping machine in the present invention.

A preferred embodiment of a deadlocked strap releasing device for a strapping machine 20 in the present invention, as shown in FIGS. 3, 4 and 5, includes a strap 21 as the same as that used in the conventional strapping machine 10, a strap moving device 22, a strap guider 23, a guide rail 25, a weld and cut device 26, a deadlocked strap releasing device 30, as main components.

The deadlocked strap releasing device 30 consists of a strap ejector 31, a spring 32, a pull rope 33, a guide tube 34 and a pull rod 35.

The strap ejector 31 has a pivot sleeve 311 in the center portion, and the pivot sleeve 311 has a center pivotal hole 312 in the axial direction for a pivot 281 to extend therein inside a machine body 28. The pivot 281 is located at one side where the strap 21 on the guider 23 is guided out of. A horizontal plate 313 is provided to extend on and toward the front side of the pivot sleeve 311, and a hook rod 314 fixed under the horizontal plate 313, Further an inverted L-shaped push member 315 extends upward from the front side of the horizontal plate 313, and the upper side of the L-shaped push member 315 faces a little below the guide rail 25. Further, an actuating member 316 extends down from the rear side of the pivot sleeve 311, having a hole 317 near its lower side.

The spring 32 is able to lengthen and shrink, having two ends formed respectively with a hook 321 hooking the hook rod 314 and a position rod 282 provided below the horizontal plate 314. Then the spring 32 supplies the strap ejector 31 with resiliency to push the horizontal plate 313 to incline up and rest on a stop rod 283 provided in the machine body 28 in an original position.

The pull rope 33 has a proper length, passing through the hole 317 of the actuating member 316 and having one end fixed with a ring-shaped head 331 of a larger diameter than that of the hole 317 so as to let the actuating member 316 able to be pulled by the pull rope 33. The other end of the pull rope 33 forms a tail 332 passing through orderly a rope guider 36 and two rope guiding holes 361, 371 of a fixing base 37 and extending out of the rope guide hole 371. The portion of the pull rope 33 between the rope guider 36 and the fixing base 37 extends in a protective tube 38, which has two ends having a bolt 381 screwing with the holes 361 and 371 to stabilize the pull rope 33 so as to let the pull rope 33 move back and forth smoothly. The fixing base 37 is fixed firmly on a side plate 284 of the machine body 28, and the rope guider 36 is fixed at a location between the fixing member 37 and the strap ejector 31.

The guide tube 34 fitted in a hole 342 of the fixing ring 341, which is made integral of flexible plastic, and fixed in a connect hole 285 bored in the side plate 284 and located striding the side plate 284 inward and outward. Further, a position ring 343 of a comparatively large diameter is fitted around the guide tube 34 in the connect hole 285 of the side plate 284 for facilitating the position ring 343 to be positioned in the connect hole 285 via the fixing ring 341. The guide tube 34 has a center guide hole 352 aligned to the rope guide hole 371.

The pull rod 35 is round, extending in the guide hole 344 of the guide tube 34, and having a rope fixing hole 351 in an inner end for the tail 332 of the pull rope 33 to fit firmly therein and a threaded hole 352 formed sidewise for a screw 353 to tighten the tail 332 in the rope fixing hole 351. Further the pull rod 35 has a knob 354 fixed on the outer end outside the machine body 28.

Figure 6:
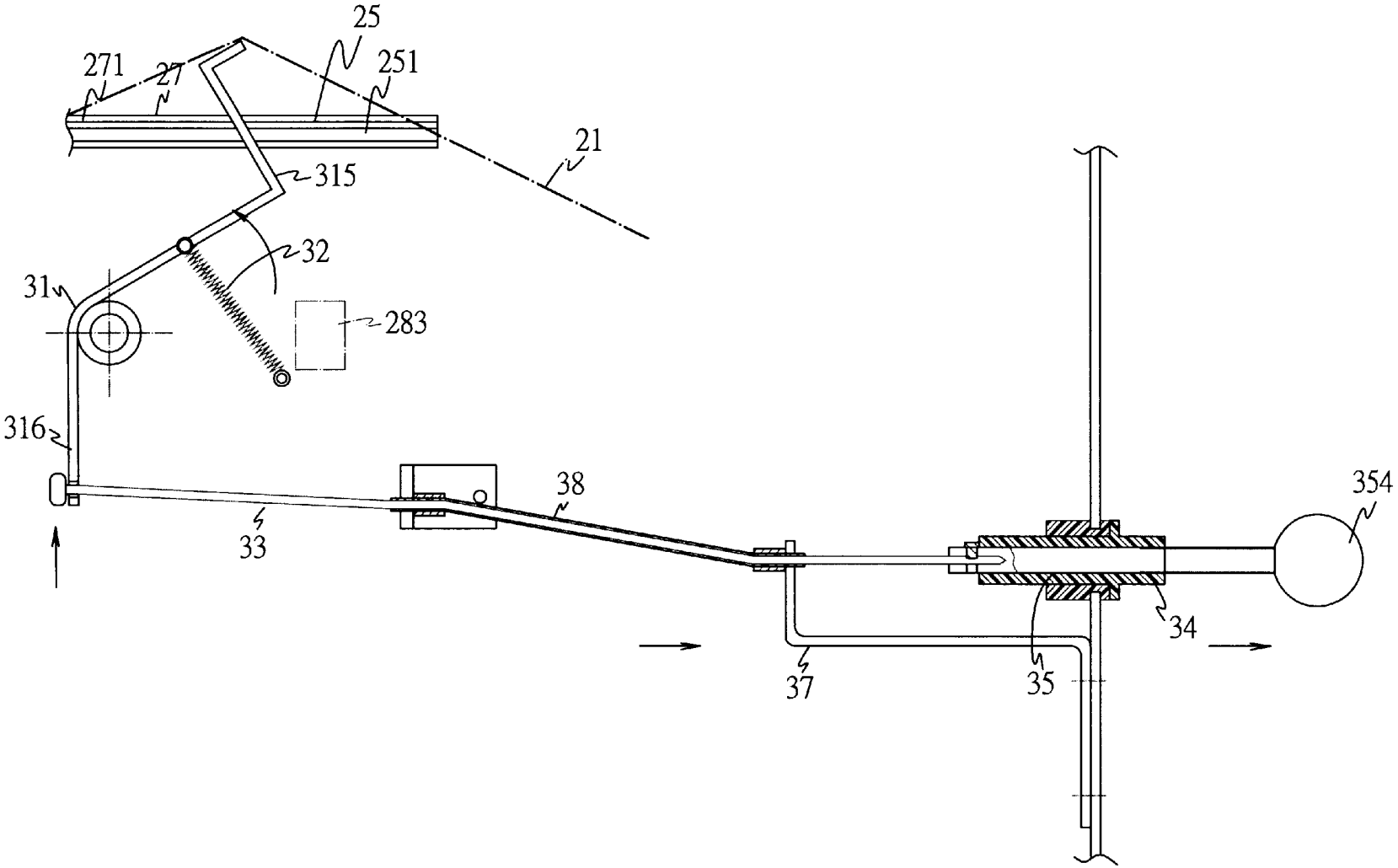
FIG. 6 is a cross-sectional vies of the strap being released by the deadlocked strap releasing device for a strapping machine in the present invention; and, FIG. 7 is a side view of a part of the deadlocked strap releasing device for a strap machine in the present invention.
Figure 7:
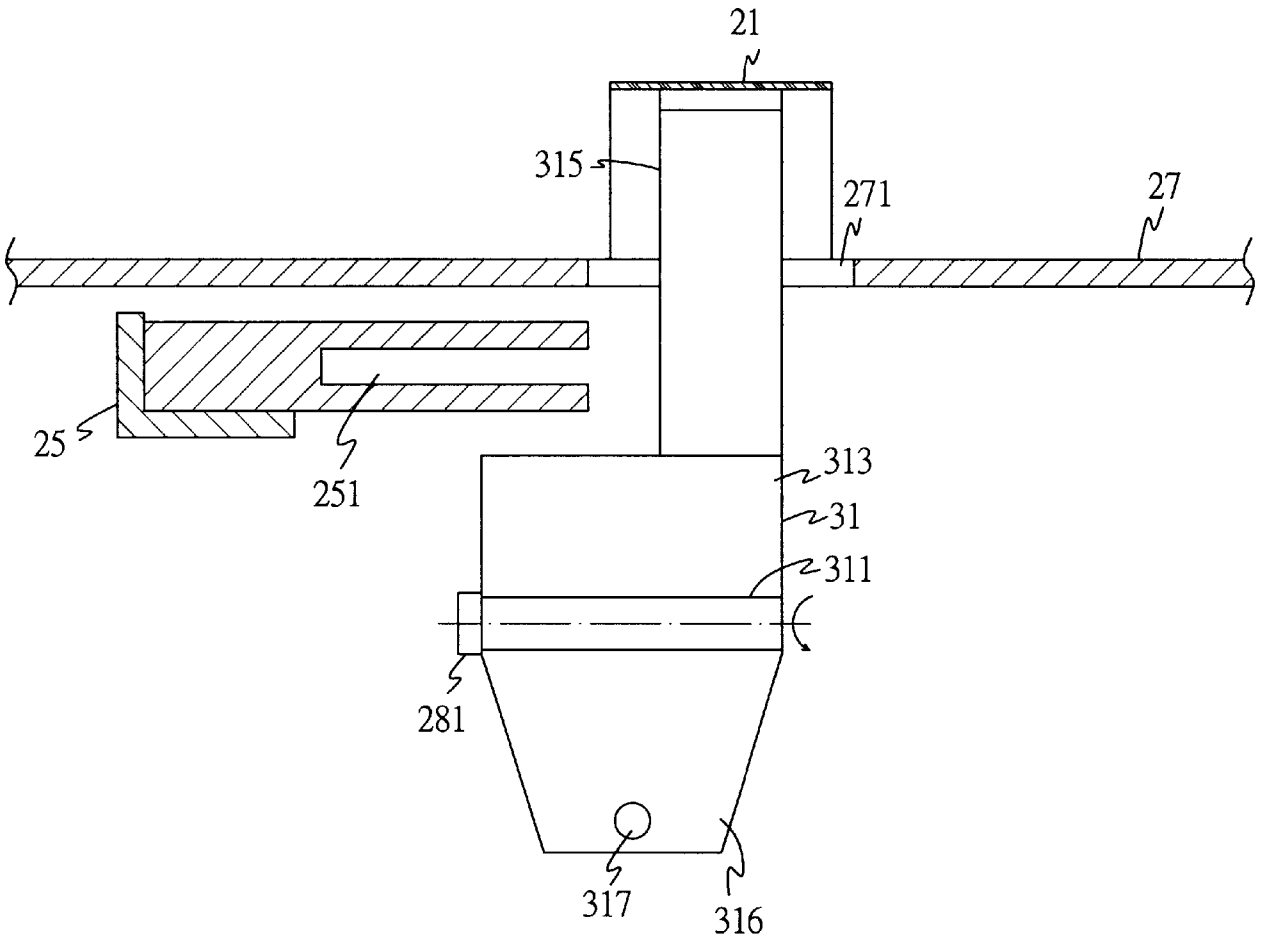

Next, the operation and function of the deadlocked strap releasing device is to be described. Referring to FIGS. 6 and 7, in case the strap 21 should be deadlocked in the guide groove 251 in strapping, the strapping machine would be stopped and the guide rail 25 is moved to one side, forcing the guide groove 251 separate from the deadlocked strap 21. Then a worker holds the knob 354 of the pull rod 35 outward, moving out the pull rope 35 at the same time, which moves the actuating member 316 outward. Then the actuating member 316 forces the horizontal plate 313 incline upward so as to force the strap ejector 31 swing with the pivot 281 so that the push member 315 pushes up to push the strap 21 protrude up out of the opening 271 for the worker to pull the strap 21 out. Then the knob 354 is released to permit the spring 32 recover its resilience to pull back the horizontal plate 313 down and rest on the stopper rod 283.So the push member 315 and the actuating member 316 returns to their original positions, as shown in FIG. 4. Now the worker can cut off the redundant portion of the strap 21 and start the strapping machine 20 to continue strapping work.

In short, the deadlocked strap releasing device in the invention uses the knob of the pull rod to push up the deadlocked strap on the work table for a worker to easily cut off the redundant portion of the strap so as to continue quickly strapping work, getting rid of the malfunction of the strapping machine with quickness, enhancing effectiveness of strapping work.

While the preferred embodiment of the invention has been described above, it will be recognized and understood that various modifications may be made therein and the appended claims are intended to cover all such modifications that may fall within the spirit and scope of the invention.

We claim:

1. A deadlocked strap releasing device for a strapping machine, provided in a machine body wherein a strap is guided by a strap moving device into a guide base and onto a guide rail to be extended to be laid on an object to be strapped on a worktable, and said deadlocked strap releasing device is positioned below said guide rail to release the strap if deadlocked, said deadlocked strap releasing device comprising:

a strap ejector having a pivot sleeve located at a side where a strap is guided out of a guider, a horizontal plate of a proper length resting on and extending from said pivot sleeve forward, a hook rod of a preset length fixed under said horizontal plate, an L-shaped push member extending up from the front side of said horizontal plate and located a little below a guide rail, and an actuating member extending downward from said horizontal plate;

a spring having one end hooking said hook rod and the other end hooking a position rod provided below said hook rod, supplying said strap ejector with resilience to move up for ejecting said strap up and let said horizontal plate rest on a stop rod provided in a machine body;

a pull rope having a proper length, one end connected with a ring-shaped head fixed with a lower end of said actuating member, the other end formed as a tail passing through a rope guider and a fixing base and protruding out of said fixing base fixed on a side plate of said machine body, said rope guider fixed at a location between said fixing base and said strap ejector;

a guide tube fixed with said side plate of said machine body, located a little above said fixing base, having an inner portion located inside said machine body and an outer portion outside said machine body, and a center guide hole; and, a pull rod pivotally fitting in said guide tube, having an inner portion located in said machine body and fixed with said tail of said pull rope and an outer portion located outside said machine body and connected with a knob at its outer end.

2. The deadlocked strap releasing device for a strapping machine as claimed in claim 1, wherein said pivot sleeve of said strap ejector has a center pivot hole for a pivot located in said machine body to extend therein, said pushing member is shaped as an inverted L, said lower end of said actuating member has a hole for said pull rope to pass through and said lower end of said actuating member has an outer end fixed with said ring-shaped head.

3. The deadlocked strap releasing device for a strapping machine as claimed in claim 1, wherein said rope guider and said fixing base respectively have a, guide hole for said pull rope to pass through, a portion of said pull rope between said rope guider and said, fixing base is fitted around with a protective tube, which has two ends, wherein each end having a stop bolt partly fitted in each of said rope guide hole to stabilize said pull rope so as to let said pull rope move back and forth smoothly.

4. The deadlocked strap releasing device for a strapping machine as claimed in claim 1, wherein said spring can lengthen and shrink, having two ends formed as a hook.

5. The deadlocked strap releasing device for a strapping machine as claimed in claim 1, said guide tube is fitted in a hole of a fixing ring, said fixing ring is fixed firmly on said side plate of said machine body, striding said side plate to position outside and inside said machine body, and a position ring of comparatively large diameter hole is fitted around said fixing ring, extending a little out of said side plate of said machine body.

6. The deadlocked strap releasing device for a strapping machine as claimed in claim 1, wherein said pull rope is a wire rope.

7. The deadlocked strap releasing device for a strapping machine as claimed in claim 1, wherein said pull rod has a rope fixing hole facing said fixing base for said tail of said pull rope to fit firmly therein, and a threaded hole provided sidewise for a screw to engage therein to stabilize said tail of said pull rope.

* * * * *